US009927745B2

(12) United States Patent
Yoshimura

(10) Patent No.: US 9,927,745 B2
(45) Date of Patent: Mar. 27, 2018

(54) IMAGE HEATING DEVICE

(71) Applicant: CANON KABUSHIKI KAISHA, Tokyo (JP)

(72) Inventor: Shotaro Yoshimura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/258,875

(22) Filed: Sep. 7, 2016

(65) Prior Publication Data

US 2017/0075267 A1 Mar. 16, 2017

(30) Foreign Application Priority Data

Sep. 11, 2015 (JP) ..... 2015-179570

(51) Int. Cl.
*G03G 15/20* (2006.01)

(52) U.S. Cl.
CPC ..... *G03G 15/2039* (2013.01)

(58) Field of Classification Search
None
See application file for complete search history.

(56) References Cited

U.S. PATENT DOCUMENTS 6,423,941 B1 * 7/2002 Kanari ..... G03G 15/2064 219/216
8,471,178 B2 6/2013 Taniguchi et al.
8,552,342 B2 10/2013 Sakakibara et al.
8,592,726 B2 11/2013 Tsuruya et al.
9,095,003 B2 7/2015 Sakakibara et al.
9,098,035 B2 8/2015 Nakahara et al.
9,445,457 B2 9/2016 Sakakibara et al.
9,494,899 B2 11/2016 Nakahara et al.
2011/0062140 A1 3/2011 Sakakibara et al.
2012/0121306 A1 5/2012 Shimura et al.
2012/0201581 A1 8/2012 Shimura et al.
2012/0201582 A1 8/2012 Shimura et al.
2012/0308280 A1 12/2012 Tsuruya et al.
2013/0209125 A1 * 8/2013 Uchitani ..... G03G 15/2042 399/69

(Continued)

FOREIGN PATENT DOCUMENTS

JP 2001-43956 A 2/2001
JP 2006-147274 A 6/2006

(Continued)

*Primary Examiner* — Thomas Giampaolo, II
(74) *Attorney, Agent, or Firm* — Canon U.S.A., Inc. IP Division

(57) ABSTRACT

An image heating device includes a heater having a substrate, a first heat generating block which is formed on the substrate and generates heat by supplied power, and a second heat generating block which is arranged at a position different from a position at which the first heat generating block is arranged in a longitudinal direction of the substrate. The device also includes a temperature detecting element and a controller to which a signal from the temperature detecting element is input. The controller controls a ratio of power supplied to the first heat generating block to power supplied to the second heat generating block to thereby switch heat generation distribution of the heater, and the temperature detecting element is arranged so as to extend across both of the first heat generating block and the second heat generating block.

10 Claims, 14 Drawing Sheets

(56) References Cited

U.S. PATENT DOCUMENTS

| | | | |
|---|---|---|---|
| 2013/0251428 | A1 | 9/2013 | Ueno et al. |
| 2013/0299480 | A1 | 11/2013 | Kakubari et al. |
| 2013/0343790 | A1 | 12/2013 | Shimura et al. |
| 2013/0343791 | A1 | 12/2013 | Shimura et al. |
| 2014/0003848 | A1 | 1/2014 | Sakakibara et al. |
| 2014/0076878 | A1 | 3/2014 | Shimura et al. |
| 2014/0169845 | A1 | 6/2014 | Nakahara et al. |
| 2015/0289317 | A1 | 10/2015 | Sakakibara et al. |
| 2015/0293483 | A1 | 10/2015 | Nakahara et al. |

FOREIGN PATENT DOCUMENTS

| | | | |
|---|---|---|---|
| JP | 2010-054846 | A | 3/2010 |
| JP | 2011-069880 | A | 4/2011 |
| JP | 2011-151003 | A | 8/2011 |
| JP | 2014-59508 | A | 4/2014 |
| JP | 2014-139660 | A | 7/2014 |
| JP | 2014-153480 | A | 8/2014 |
| JP | 2015-194713 | A | 11/2015 |

* cited by examiner

FIG. 5A

| STATE | WIDTH OF RECORDING MATERIAL | TRIAC 416 | TRIAC 426 | TRIAC 436 | TEMPERATURE OF THERMISTOR TH2 |
|---|---|---|---|---|---|
| STATE I | DL ENVELOPE | ON | OFF | OFF | LOW |
| | COM10 ENVELOPE | ON | OFF | OFF | LOW |
| STATE II | A5 | ON | ON | OFF | MIDDLE |
| STATE III | LETTER | ON | ON | ON | HIGH |
| | LEGAL | ON | ON | ON | HIGH |
| | A4 | ON | ON | ON | HIGH |

(STATE I)

IMAGE HEATING DEVICE

BACKGROUND

Field

Aspects of the present invention generally relate to an image heating device such as a fixing unit mounted in an image forming apparatus of an electrophotographic recording type, such as a copier or a printer, or a glossing device for improving a toner image in gloss by heating a fixed toner image on a recording material again.

Description of the Related Art

As an image heating device, there is a device having a cylindrical film, a heater in contact with an inner surface of the film, and a roller forming a nip portion via the film together with the heater. When an image forming apparatus provided with such an image heating device performs continuous printing using small-sized paper, a phenomenon occurs in which temperature of a region through which sheets do not pass in a longitudinal direction of the nip portion gently increases (temperature rise in a sheet non-passing portion). If the temperature of the sheet non-passing portion becomes too high, individual parts in the device may be damaged, or if printing is performed by using large-sized paper while the temperature rise in the sheet non-passing portion is generated, high-temperature offset of toner may occur to the film in a region corresponding to the sheet non-passing portion of the small-sized paper.

As one of methods for suppressing such a temperature rise in the sheet non-passing portion, a device which switches heat generation distribution of a heater according to a size of a recording material by dividing a heat generating resistor on the heater into a plurality of groups (heat generating blocks) in a longitudinal direction of the heater is proposed (Japanese Patent Laid-Open No. 2014-59508).

When the heat generating resistor is divided into the plurality of heat generating blocks, a temperature detecting element can be arranged on each of the heat generating blocks in order to monitor abnormal heat generation of the heater.

However, as the number of the heat generating blocks increases, the number of the temperature detecting elements for monitoring the temperature also increases.

SUMMARY

An image heating device includes a heater having a substrate, a first heat generating block which is formed on the substrate and generates heat by supplied power, and a second heat generating block which is arranged at a position different from a position at which the first heat generating block is arranged in a longitudinal direction of the substrate. The device also includes a temperature detecting element and a controller to which a signal from the temperature detecting element is input. The controller controls a ratio of power supplied to the first heat generating block to power supplied to the second heat generating block to thereby switch heat generation distribution of the heater, and the temperature detecting element is arranged so as to extend across both of the first heat generating block and the second heat generating block.

Further features of aspects of the present invention will become apparent from the following description of exemplary embodiments with reference to the attached drawings.

BRIEF DESCRIPTION OF THE DRAWINGS

FIGS. 5A and 5B illustrate temperature distribution of the heater according to the exemplary embodiment 1.

DESCRIPTION OF THE EMBODIMENTS

Exemplary Embodiment 1

Figure 1:
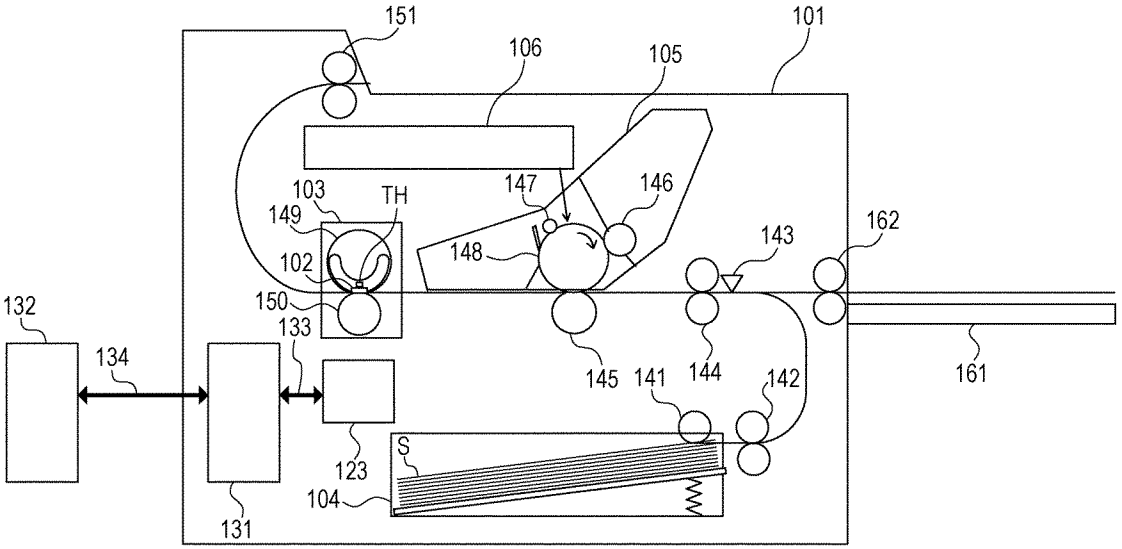
FIG. 1 illustrates a configuration of a printer.

FIG. 1 is a cross-sectional view illustrating a schematic configuration of an image forming apparatus using an electrophotographic process. A printer 101 illustrated in FIG. 1 has a sheet supplying cassette 104 in which a recoding material S is contained. The printer 101 also has a sheet feeding roller 141 for feeding the recording material S from the sheet supplying cassette 104, a conveyance roller pair 142, a top sensor 143 for detecting a front edge of the recording material S, and a registration roller pair 144 for conveying the recording material S in a synchronous manner. The reference numeral 105 denotes a cartridge unit 105 for forming a toner image on the recording material S based on a laser beam from a laser scanner 106. The cartridge unit 105 has a photosensitive drum 148, a primary charging roller 147, a developing roller 146, and the like, which are necessary for the known electrophotographic process, and forms the toner image on the recording material S together with a transferring roller 145. The reference numeral 103 denotes a heat fixing unit which is one example of an image heating device for fixing the toner image, which is formed on the recording material S, onto the recording material S. The heat fixing unit 103 has a fixing film 149, a pressing roller 150, and a heater 102 arranged inside the fixing film 149. The heat fixing unit 103 further has a thermistor TH which is arranged inside the fixing film 149 and is a temperature detecting element for detecting temperature of the heater 102. The reference numeral 151 denotes a discharge roller pair for conveying the recording material S subjected to fixing processing.

The reference numeral 123 denotes a controller (hereinafter, referred to as a CPU 123) for controlling a driving unit (not illustrated) such as a motor or a clutch to thereby operate each roller and control conveyance of the recording material S. The CPU 123 further performs control of the laser scanner 106, the cartridge unit 105, the heat fixing unit 103, and the like. The reference numeral 131 denotes a video controller for performing connection to the CPU 123 with use of a video interface 133 and accepting an image signal through an external apparatus 132, such as a personal computer, and a versatile interface 134 (such as USB).

The printer 101 can handle a plurality of sizes of recording materials. In the sheet supplying cassette 104, Letter paper (approximately 216 mm×279 mm), Legal paper (approximately 216 mm×356 mm), A4 paper (210 mm×297 mm), Executive paper (approximately 184 mm×267 mm), and the like are able to be set. Further, JIS B5 paper (182 mm×257 mm), A5 paper (148 mm×210 mm), and the like are also able to be set. In addition, the printer 101 is able to perform printing on non-standard-sized paper such as a DL envelope (110 mm×220 mm) or a COM10 envelope (approximately 105 mm×241 mm) by feeding the non-standard-sized paper from a sheet feed tray 161. The reference numeral 162 denotes a roller for picking up the recording material S from the sheet feed tray 161.

Note that, the printer 101 basically feeds paper by short edge feeding (conveys paper so that a long side thereof is parallel to a conveying direction). The recording materials S having the largest width among standard-sized recording materials S that the printer 101 of the present example can handle are Letter paper and Legal paper which are approximately 216 mm in width. The recording material S having a smaller width than a maximum size that the printer 101 can handle is defined as small-sized paper in the present exemplary embodiment.

Figure 2:
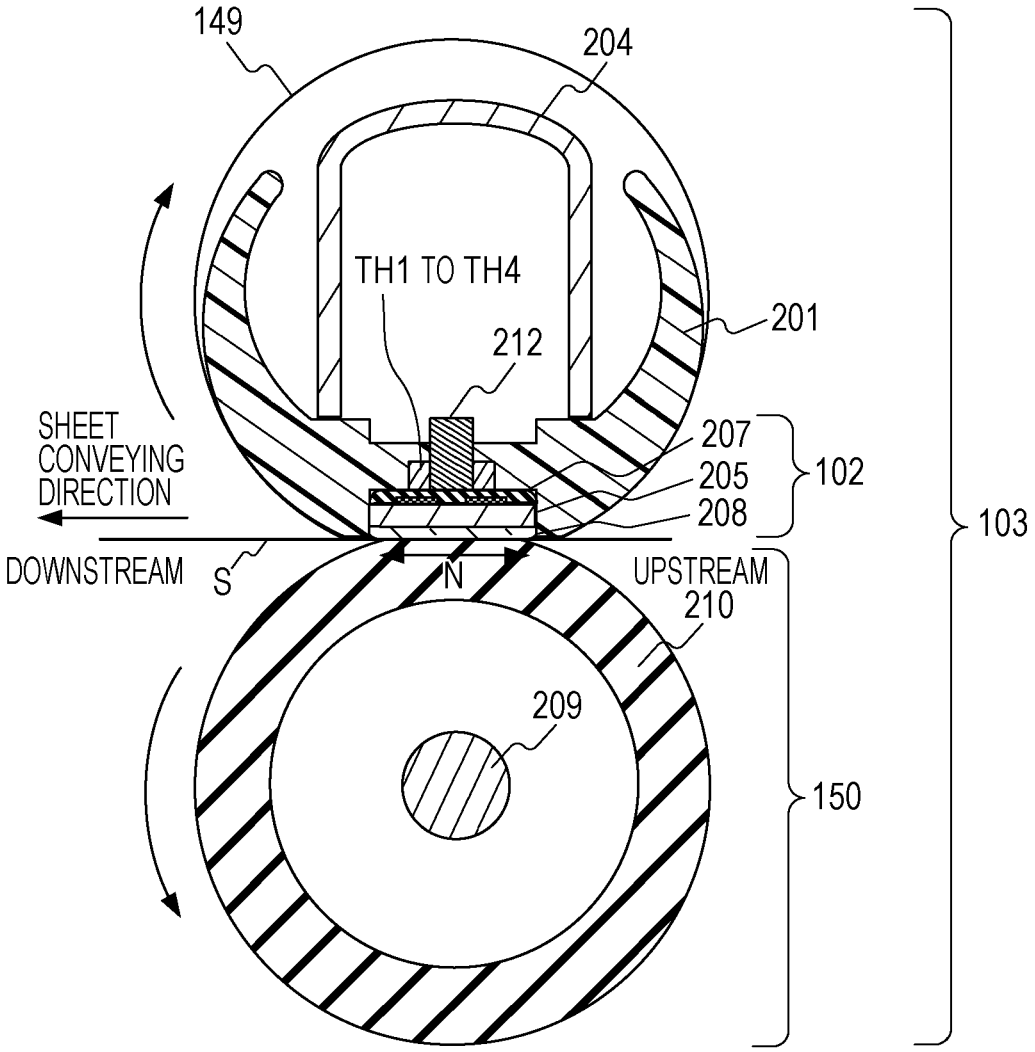
FIG. 2 illustrates a configuration of a heat fixing unit.

FIG. 2 is a cross-sectional view of the heat fixing unit 103. In the heat fixing unit 103, the heater 102 in contact with an inner surface of the cylindrical fixing film 149 forms a fixing nip portion N via the fixing film 149 together with the pressing roller 150. A material of a base layer of the fixing film 149 is a heat-resistant resin such as polyimide or a metal such as stainless steel. The pressing roller 150 has a core metal 209 made of a material such as iron or aluminum and an elastic layer 210 made of a material such as silicone rubber. The heater 102 is held by a holding member 201 which is made of a heat resistant resin. The holding member 201 has a guiding function for guiding rotation of the fixing film 149. When receiving power from a motor (not illustrated), the pressing roller 150 rotates in a direction of an arrow. The fixing film 149 rotates following the rotation of the pressing roller 150.

The heater 102 has a heat generating resistor provided on a back surface (holding member 201 side) of a ceramic substrate 205, and a surface protection layer 207 (glass is used in the present exemplary embodiment) which covers the heat generating resistor and has insulation property. A surface protection layer 208 (sliding glass is used in the present exemplary embodiment) coated with sliding glass or polyimide is formed on a surface (fixing film 149 side) of the substrate 205. A thermistor TH1 and a thermistor TH2 for detecting temperature of the heater 102 contact a back surface side of the heater 102. In addition, a safety element 212, such as a thermal switch or a thermal fuse, which is turned on when abnormal temperature rise of the heater 102 occurs and the power supplied to the heater 102 is stopped, also contacts the back surface side of the heater 102. A contact position thereof is within a sheet passing region of the recording material S having the smallest width. The reference numeral 204 denotes a metal stay for exerting force of a spring (not illustrated) on the holding member 201.

Figure 3A:
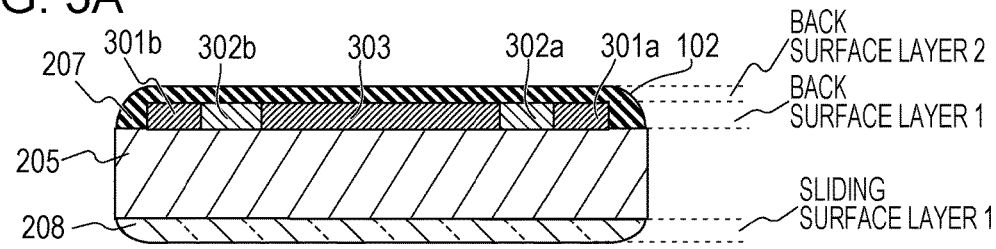
FIGS. 3A to 3C illustrate configurations of a heater according to an exemplary embodiment 1.
Figure 3B:
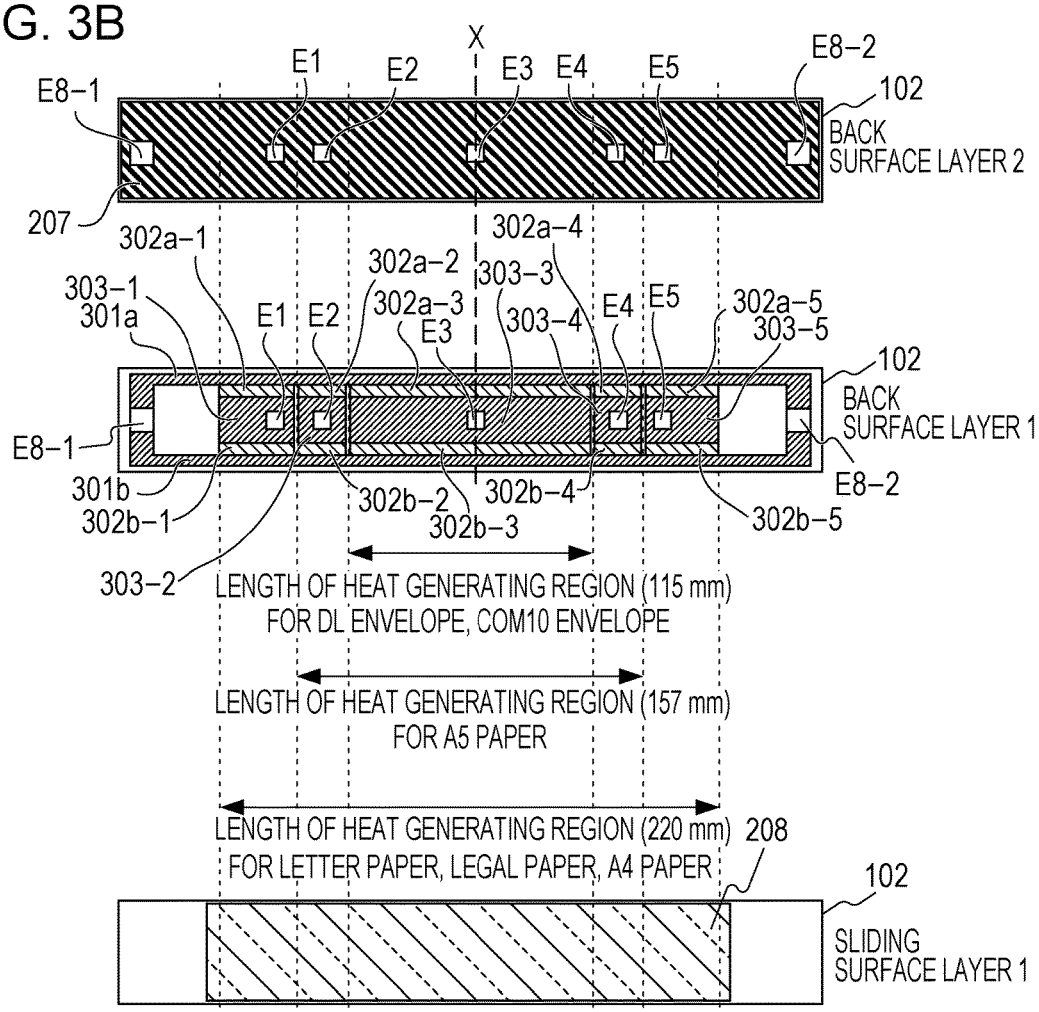
Figure 3C:
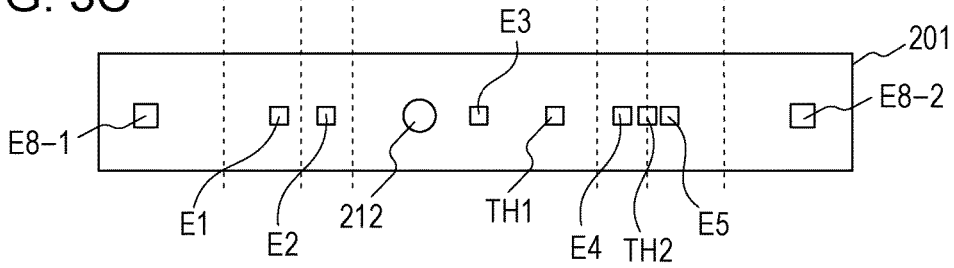

FIGS. 3A to 3C illustrate configurations of the heater 102 according the exemplary embodiment 1. FIG. 3A is a cross-sectional view of the heater 102 taken along a widthwise direction. A conductive element 301 (divided into a conductive element 301*a* and a conductive element 301*b*) and a conductive element 303 are provided on a back surface layer 1 of the substrate 205 along a longitudinal direction of the heater 102. The conductive element 301*a* is arranged on an upstream side in the conveying direction of the recording material S (widthwise direction of the heater 102) and the conductive element 301*b* is arranged on a downstream side therein. The conductive element 303 is arranged in the center in the widthwise direction of the heater 102. A heat generating resistor 302*a* is provided between the conductive element 301*a* and the conductive element 303 and a heat generating resistor 302*b* is provided between the conductive element 302*a* and the conductive element 303. Power is supplied to the heat generating resistor 302*a* via the conductive element 301*a* and the conductive element 303 and to the heat generating resistor 302*b* via the conductive element 301*b* and the conductive element 303.

In a case where heat generation distribution of the heater 102 becomes asymmetry in the widthwise direction, stress exerted on the substrate 205 when the heater 102 generates heat increases. When the stress exerted on the substrate 205 increases, a crack occurs in the substrate 205 in some cases. Thus, the heat generating resistor 302*a* is arranged on the upstream side in the conveying direction and the heat generating resistor 302*b* is arranged on the downstream side therein, and the heat generating resistor 302*a* and the heat generating resistor 302*b* generate heat at the same time, so that the heat generation distribution of the heater 102 becomes symmetry in the widthwise direction.

FIG. 3B is a plan view of each layer of the heater 102. The heat generating resistor 302 is divided into a plurality of pieces in the longitudinal direction of the heater 102. The heater 102 has a heat generating block 302-3, which is a central heat generating block for generating heat regardless of a size of a recording material, at a center portion in the longitudinal direction of the heater 102. The heater 102 also has a heat generating block 302-1 and a heat generating block 302-2 at one end and a heat generating block 302-4 which is a first heat generating block and a heat generating block 302-5 which is a second heat generating block at the other end. In this manner, the heater 102 has five heat generating blocks in total. The heat generating block 302-1 is constituted by a heat generating resistor 302*a*-1 and a heat generating resistor 302*b*-1 which are formed in a symmetrical manner in the widthwise direction of the heater 102. Similarly, heat generating blocks 302-2 to 302-5 are respectively constituted by heat generating resistors 302*a*-2 to 302*a*-5 and heat generating resistors 302*b*-2 to 302*b*-5. Similarly to the heat generating resistor, the conductive element 303 is also divided into five conductive elements 303-1 to 303-5 along the longitudinal direction of the heater 102 as illustrated in FIG. 3B, the heat generating resistors 302*a*-1 to 302*a*-5 and the heat generating resistors 302*b*-1 to 302*b*-5 are respectively connected thereto. The respective heat generating blocks are constituted so that current flows through the heat generating resistors in each of the heat generating blocks in the widthwise direction of the substrate.

Dividing positions of the heat generating blocks are determined according to a passing region of the recording material S which is conveyed. In the present exemplary embodiment, the recording material S is conveyed in the widthwise direction of the heater 102 with a reference position X as a conveyance reference of the recording material. Thus, the dividing positions of the heat generating blocks are set so as to be divided in a symmetrical manner at positions corresponding to sizes of the recording material S with the conveyance reference position X as a central axis. In the present exemplary embodiment, fixing is performed by using the heat generating block 302-3 as the heat generating block for a DL envelope and a COM10 envelope and three blocks obtained by adding the heat generating block 302-2 and the heat generating block 302-4 to the heat generating block 302-3 as the heat generating blocks for A5 paper. Fixing is performed by using all the heat generating blocks (five blocks) obtained by adding the heat generating block 302-1 and the heat generating block 302-5 to the three blocks as the heat generating blocks for Letter paper, Legal paper, and A4 paper. Note that, the number of division, the dividing positions, and the like are not limited to those of the configuration of the exemplary embodiment.

Electric contacts for supplying power to each of the heat generating blocks from a control circuit 400 of the heater 102, which will be described below, are connected to electrodes E1 to E5, an electrode E8-1, and an electrode E8-2. The electrode E1 is an electrode for feeding power to the heat generating block 302-1 via the conductive element 303-1. Similarly, the electrodes E2 to E5 are electrodes for respectively feeding power to the heat generating blocks 302-2 to 302-5 via the conductive elements 303-2 to 303-5. The electrode E8-1 and the electrode E8-2 are common electrodes for feeding power to the five heat generating blocks 302-1 to 302-5 via the conductive element 301*a* and the conductive element 301*b*.

Meanwhile, heat generation distribution of the heater 102 in the longitudinal direction is influenced by a resistance value of each of the conductive elements because the resistance value is not zero. Thus, the electrode E8-1 and the electrode E8-2 are provided at each end of the heater 102 in the longitudinal direction so that heat generation distribution of the heater 102, which is symmetrical in the longitudinal direction, is able to be obtained even when there is influence of electric resistance of the conductive elements 303-1 to 303-5.

The surface protection layer 207 is formed other than portions of the electrodes E1 to E5, the electrode E8-1, and the electrode E8-2, and is configured to allow electric connection to each electrode from the back surface side of the heater 102.

As illustrated in FIG. 3C, the holding member 201 of the heater 102 has holes into which the thermistor TH1 which is a temperature detecting element used for temperature control and the thermistor TH2 which is a temperature detecting element used for abnormality detection are inserted. The holding member 201 further has holes for the safety element 212, the electrodes E1 to E5, the electrode E8-1, and the electrode E8-2. Between the stay 204 and the holding member 201, the thermistors TH1 and the TH2, the safety element 212, and the electric contacts in contact with the electrodes E1 to E5, the electrode E8-1, and the electrode E8-2 are provided. These elements and electric contacts are arranged facing the back surface of the heater 102. The thermistor TH1 is arranged at a position to detect temperature of the heat generating block 302-3 and the thermistor TH2 is arranged at a position between the heat generating block 302-4 and the heat generating block 302-5 to detect temperature of both of the heat generating blocks. Each of the electric contacts in contact with the electrodes E1 to E5, the electrode E8-1, and the electrode 8-2 is electrically connected to an electrode unit of the heater 102 with a method of biasing by a spring, welding, or the like. Each of the electric contacts is connected to the control circuit 400 of the heater 102 described below via a conductive material, such as a cable or a thin metal plate, provided between the stay 204 and the holding member 201.

As described above, the heater 102 has the substrate 205, and the first heat generating block 302-4 which is formed on the substrate 205 and generates heat by supplied power. The heater 102 also has the second heat generating block 302-5 which is arranged at a position different from the position at which the first heat generating block 302-4 is arranged in the longitudinal direction of the substrate 205 and is controlled independently from the first heat generating block 302-4. By controlling a ratio of power supplied to the first heat generating block 302-4 and power supplied to the second heat generating block 302-5, the heat generation distribution of the heater 102 is able to be switched. The heat fixing unit 103 has the temperature detecting element TH2 arranged so as to extend across both of the first heat generating block 302-4 and the second heat generating block 302-5.

Figure 4:
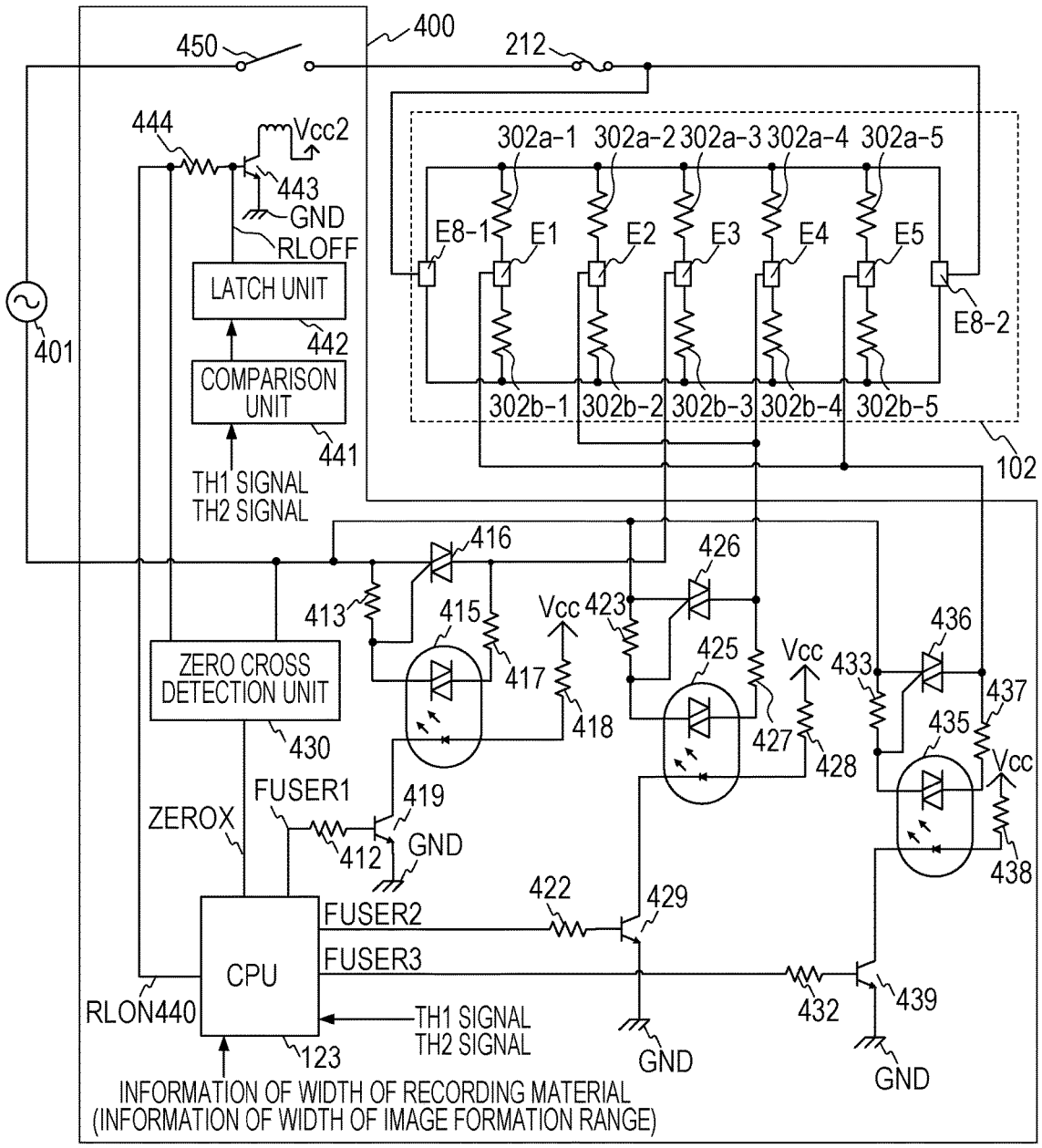
FIG. 4 illustrates a control circuit of the heater according to the exemplary embodiment 1.

FIG. 4 is a circuit diagram of the control circuit 400 for performing power control of the heater 102. The reference numeral 401 denotes a commercial alternating current power supply connected to the printer 101. The alternating current power supply 401 is connected to the electrode E8-1 and the electrode E8-2 of the heater 102 via a relay 450 and the safety element 212. The electrodes E1 to E5 are connected to a triac 416, a triac 426, and a triac 436. By controlling the triacs 416, 426, and 436, it is possible to independently control the heat generating block 302-3; the heat generating block 302-2 and the heat generating block 302-4; and the heat generating block 302-1 and the heat generating block 302-5.

Next, an operation of the triac 416 will be described. A resistor 413 and a resistor 417 are bias resistors for the triac 416. A phototriac coupler 415 is a device for maintaining a creepage distance between primary and secondary circuits. The triac 416 is turned on when a light emitting diode of the phototriac coupler 415 is energized. A resistor 418 is a resistor for limiting current flowing through the light emitting diode of the phototriac coupler 415 from a power supply voltage Vcc. The phototriac coupler 415 is turned on/off by a transistor 419. The transistor 419 operates according to a FUSER1 signal from the CPU 123. When the triac 416 is energized, power is supplied to the heat generating resistor 302*a*-3 and the heat generating resistor 302*b*-3.

Since circuit operations of the triac 426 and the triac 436 are the same as that of the triac 416, description thereof will be omitted. The triac 426 operates according to a FUSER2 signal from the CPU 123. When the triac 426 is energized, power is supplied to the heat generating resistor 302*a*-2 and the heat generating resistor 302*b*-2, and the heat generating resistor 302*a*-4 and the heat generating resistor 302*b*-4. The transistor 436 operates according to a FUSER3 signal from the CPU 123. When the triac 436 is energized, power is supplied to the heat generating resistor 302*a*-1 and the heat generating resistor 302*b*-1, and the heat generating resistor 302*a*-5 and the heat generating resistor 302*b*-5.

The relay 450 is used as a power stopping unit configured to stop power supply to the heater 102 with outputs from the thermistors TH1 and TH2 when the temperature of the heater 102 excessively increases due to failure or the like. When a RLON440 signal enters a high state, a transistor 443 is turned on, a secondary coil of the relay 450 is energized from a power supply voltage Vcc2, and a primary contact of the relay 450 enters an on state. When the RLON440 signal enters a low state, the transistor 443 is turned off, the current flowing through the secondary coil of the relay 450 from the power supply voltage Vcc2 is stopped, and the primary contact of the relay 450 enters an off state.

Next, an operation of a safety circuit using the relay 450 will be described. When any one of detected temperatures of the thermistors TH1 and TH2 is over a predetermined temperature which is set for each of them, a comparison unit 441 operates a latch unit 442 and the latch unit 442 latches a RLOFF signal in a low state. When the RLOFF signal enters the low state, the off state of the transistor 443 is maintained even when the CPU 123 causes the RLON440 signal to enter the high state, thus making it possible to maintain the off state (safety state) of the relay 450. When the detected temperatures of the thermistors TH1 and TH2 are not over the predetermined temperature which is set for each of them, the RLOFF signal of the latch unit 442 enters an open state. Thus, when the CPU 123 causes the RLON440 signal to enter the high state, the relay 450 is able to enter the on state so that the power is able to be supplied to the heater 102.

A zero detection unit 430 is a circuit for detecting zero crossing of the alternating current power supply 401 and outputs a ZEROX signal to the CPU 123. The ZEROX signal is used for controlling the heater 102.

Next, a method for controlling the temperature of the heater 102 will be described. The temperatures detected by the thermistors TH1 and TH2 are detected by the CPU 123 as a TH1 signal and a TH2 signal with voltage divided using resistors (not illustrated). Based on the temperature detected by the thermistor TH1 and the temperature set to the heater 102, the CPU 123 calculates the power to be supplied, for example, through PI control. Further, the CPU 123 converts the power to a control level of a phase angle (phase control) or a wave number (wave number control), which corresponds to the power to be supplied, and controls the triacs 416, 426, and 436 according to the control level.

The thermistor TH1 is in a region of the heat generating block 302-3 and detects the temperature of the heat generating block 302-3. The thermistor TH2 is arranged between the heat generating block 302-4 and the heat generating block 302-5 so as to extend across both of the heat generating blocks and detects the temperatures of both of the heat generating blocks. The thermistor TH2 is configured so that the temperature detecting element and a heat collecting plate are integrated and heat of both of the heat generating blocks is efficiently collected by the heat collecting plate so as to transmit the heat to the temperature detecting element. In this case, the thermistors TH1 and TH2 are not arranged on the heat generating resistor 302*a* or the heat generating resistor 302*b* but on the conductive element 303. However, with the substrate 205 having high heat conductivity and the conductive element 303 having high heat conductivity, the temperatures are able to be detected in the almost same manner as a case where the thermistors TH1 and TH2 are arranged on the heat generating resistor 302*a* or the heat generating resistor 302*b*. The power control for the heater 102 is performed based on the detected temperature of the thermistor TH1. Each of the heat generating resistors, that is, each of the heat generating blocks has a resistance value adjusted so that the heat distribution of the heater 102 in the longitudinal direction is uniform. When each of the heat generating blocks has equal applied voltage and energizing ratio, each of the heat generating blocks has an almost uniform temperature. Thus, the CPU 123 controls the triac 416 based on temperature information from the thermistor TH1 and controls power supply to the heat generating block 302-3 so that the temperature of the heat generating block 302-3 is desirable set temperature. When the wide recording material S, such as Letter paper or Legal paper, is passed through, the power supplied to the heat generating blocks 302-2 and 302-4 and the heat generating blocks 302-1 and 302-5 is made the same as the power supplied to the heat generating block 302-3. That is, by matching the energizing ratio of the triac 426 and the triac 436 with the energizing ratio of the triac 416, it is possible to control the temperatures of the heat generating blocks 302-1 to 302-5 to be almost uniform. Similarly, also in a case where the recording material S which is narrow, such as A5 paper, is passed through, the energizing ratio supplied to the heat generating blocks 302-2 and 302-4 is made the same as the energizing ratio supplied to the heat generating block 302-3.

Figure 5B:
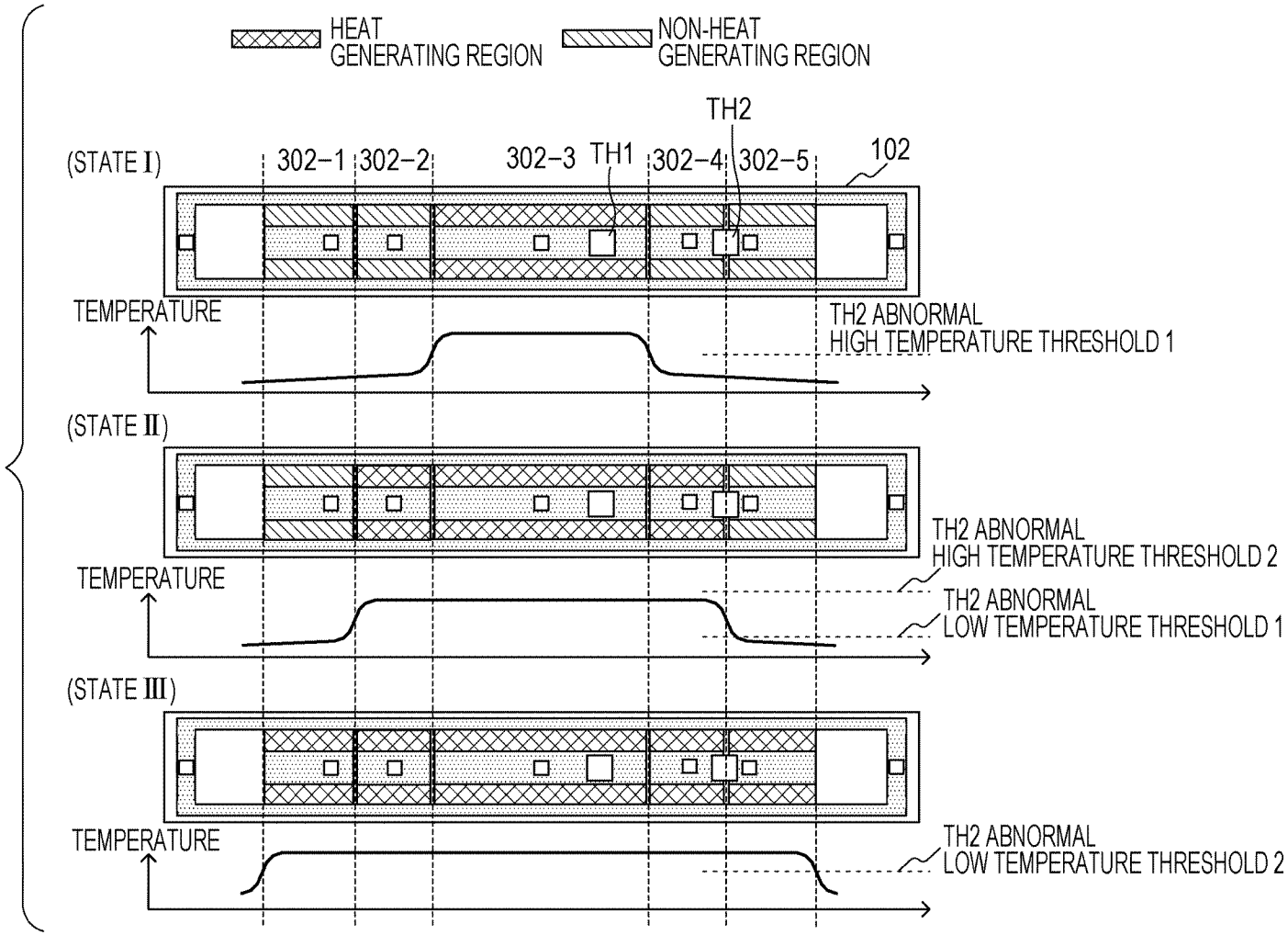

FIGS. 5A and 5B illustrate a relation between a width of the recording material S (size of the recording material) and control states of the triacs 416, 426, and 436. When the width of the recording material S to be passed through is detected as a size of a DL envelope or a COM10 envelope, the CPU 123 drives the triac 416. Thus, only the heat generating block 302-3 through which the recording material S passes is caused to generate heat like in a state I. At this time, since the heat generating blocks 302-2, 302-4, 302-1, and 302-5 do not generate heat, the temperature detected by the thermistor TH2 is detected as a much lower temperature than that of the thermistor TH1 like in the state I. In this case, when the temperature detected by the thermistor TH2 is higher than an assumed temperature, that is, when being over a TH2 abnormal high temperature threshold 1 in the state I of FIG. 5A, the CPU 123 judges that the temperature abnormal and stops power supply to the heater 102. Here, the TH2 abnormal high temperature threshold 1 is set to a temperature which is not reached in a normal control state, that is, when the heat generating block 302-4 and the heat generating block 302-5 are in the off state.

Next, when the width of the recording material S is detected as an A5 size, the CPU 123 drives the triacs 416 and 426. Thus, the heat generating blocks 302-3, 302-2, and 302-4 through which the recording material S passes are caused to generate heat like in a state II. At this time, since the heat generating blocks 302-1 and the heat generating block 302-5 do not generate heat, the thermistor TH2 detects the temperature slightly lower than that of the thermistor TH1, with the heat generating block 302-4 which generates heat and the heat generating block 302-5 which does not generate heat. When the temperature detected by the thermistor TH2 is higher than an assumed temperature, that is, when being over a TH2 abnormal high temperature threshold 2 of the state II, or when the temperature detected by the thermistor TH2 is lower than the assumed temperature, that is, being lower than a TH2 abnormal low temperature threshold 1, the CPU 123 judges that the temperature is abnormal. Then, the CPU 123 stops power supply to the heater 102. Here, the TH2 abnormal high temperature threshold 2 is set to a temperature which is not reached when the heat generating blocks 302-1 and 302-5 are in the off state. Further, the TH2 abnormal low temperature threshold 1 is set to a temperature which is not lower than the temperature to be detected by the thermistor TH2 when the heat generating blocks 302-2 and 302-4 are controlled with the same energizing ratio as that of the heat generating block 302-3.

Next, when the width of the recording material S is detected as a Letter, Legal, or A4 size, all the heat generating blocks 302-1 to 302-5 need to be caused to generate heat like in a state III, so that all the triacs 416, 426, and 436 are driven. At this time, the temperature detected by the thermistor TH2 is the temperature substantially the same as that of the thermistor TH1. When the temperature detected by the thermistor TH2 is lower than an assumed temperature, that is, when being lower than a TH2 abnormal low temperature threshold 2 of the state III, the CPU 123 judges that the temperature is abnormal and stops power supply to the heater 102. Here, the TH2 abnormal low temperature threshold 2 is set to a temperature which is not lower than the temperature to be detected by the thermistor TH2 when the heat generating blocks 302-2, 302-4, 302-1, and 302-5 are controlled with the same energizing ratio as that of the heat generating block 302-3.

In this manner, when the detected temperature of the temperature detecting element TH2 reaches the threshold which is set according to a ratio of power supplied to the first heat generating block 302-4 to power supplied to the second heat generating block 302-5, the heat fixing unit 103 is judged to be abnormal. When being judged to be abnormal, power supply to the heat generating block is stopped.

As illustrated in FIG. 4, the TH1 signal and the TH2 signal are input also to the comparison unit 441. When any one of the detected temperatures of the thermistors TH1 and TH2 is over each of the predetermined values set by the comparison unit 441, the comparison unit 441 operates the latch unit 442 to turn off the relay 450, thus making it possible to safely stop power to the heater 102. For example, when the temperatures of the heat generating block 302-2 and the heat generating block 302-4 increase due to failure of the triac 426 or the like, the thermistor TH2 detects temperature higher than that of the thermistor TH1. Further, when the predetermined temperature set by the comparison unit 441 is exceeded, the latch unit 442 latches the RLOFF signal in the low state to turn off the relay 450, so that power to the heater 102 is stopped. Also in the case of failure of the triac 436, the detected temperature of the thermistor TH2 increases similarly, and by turning off the rely 450, power to the heater 102 is able to be stopped.

As illustrated in FIGS. 5A and 5B, when the adjacent heat generating blocks are respectively in the on state and the off state, for example, when the heat generating block 302-4 is subjected to temperature control and the adjacent heat generating block 302-5 is in the off state, the temperature distribution of the heater 102 in the longitudinal direction sharply changes across a boundary between the heat generating blocks. At this time the temperature detected by the thermistor TH2 becomes a value which is almost intermediate between the temperatures of the heat generating block 302-4 and the heat generating block 302-5. Thus, when both of the heat generating blocks are subjected to temperature control or when being in the off state, the temperatures of the heat generating block 302-4 and the heat generating block 302-5 are almost the same and the temperature detected by the thermistor TH2 also becomes almost the same as the temperatures of both of the heat generating blocks. Accordingly, by detecting the control states of the heat generating blocks and the temperature detected by the thermistor TH2, it is possible to judge whether the temperature control of the heater 102 is performed appropriately or has abnormality.

Figure 6:
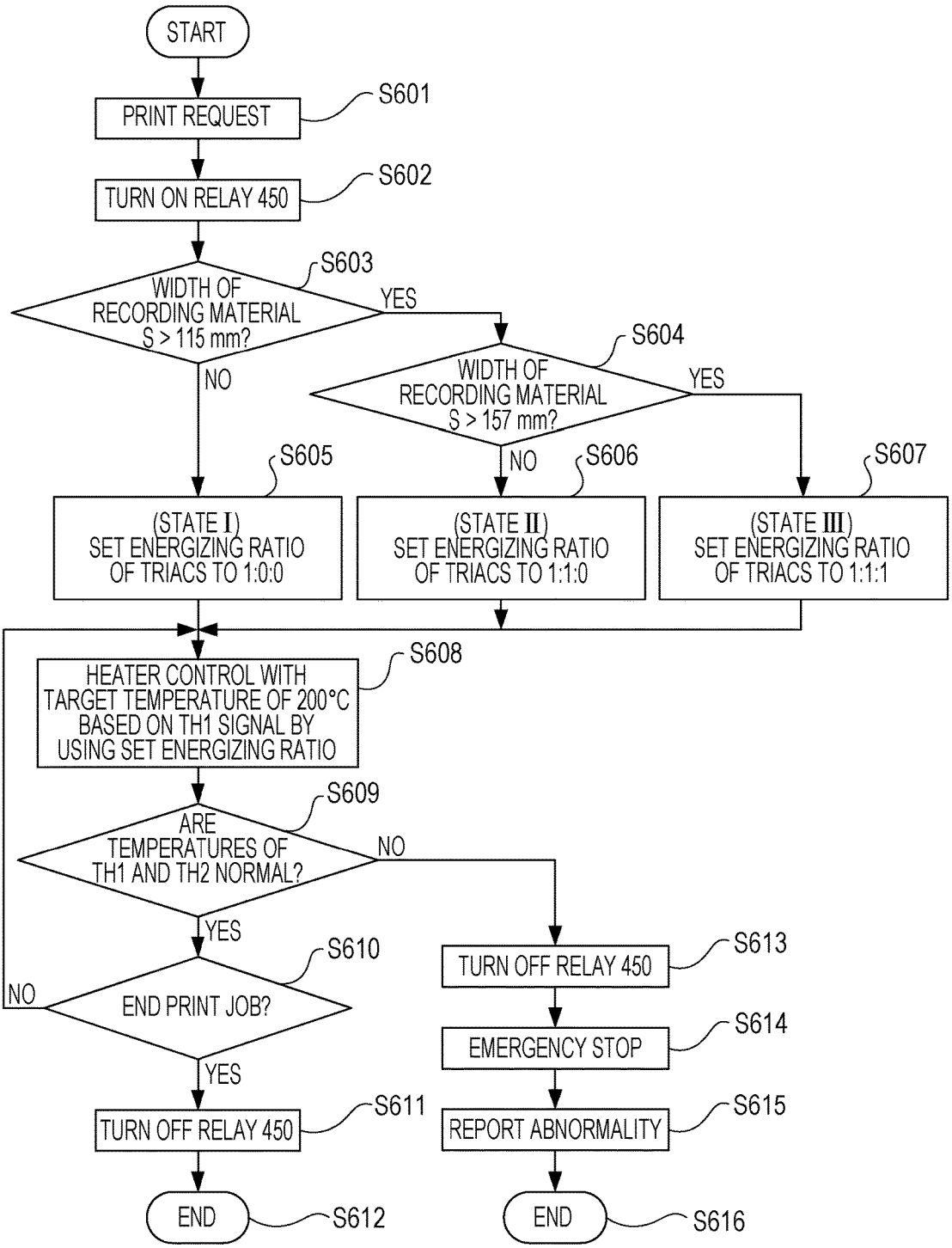
FIG. 6 is a flowchart illustrating control of the heater according to the exemplary embodiment 1.

FIG. 6 is a flowchart for explaining a control sequence of the heat fixing unit 103 by the CPU 123. When a print request is generated at S601, the relay 450 is turned on at S602. Subsequently, whether the width of the recording material S is 115 mm or more is judged at S603. In the case of Letter paper, Legal paper, A4 paper, Executive paper, B5 paper, A5 paper, non-standard paper with a width of 115 mm or more and fed from the sheet feed tray 161, or the like, the procedure moves to S604. When the width of the recording material S is 115 mm or less (a DL envelop, a COM10 envelop, non-standard paper with a width of 115 mm or less, or the like), the procedure moves to S605 and the energizing ratio of the triacs 416, 426, and 436 is set to 1:0:0 (state I).

Whether or not the width of the recording material S is 157 mm or more is judged at S604. When the width of the recording material S is 157 mm or less (A5 paper or non-standard paper with a width of 157 mm or less), the procedure moves to S606. Then, the energizing ratio of the triacs 416, 426, and 436 is set to 1:1:0 (state II). When the width of the recording material S is 157 mm or more (Letter paper, Legal paper, A4 paper, Executive paper, B5 paper, or non-standard paper with a width of 157 mm or less), the procedure moves to S607. Then, the energizing ratio of the triacs 416, 426, and 436 is set to 1:1:1 (state III).

Note that, a method for judging the width of the recording material S at S603 and S604 may be any method and examples thereof include a method using a paper-width sensor provided in the sheet supplying cassette 104 or the sheet feed tray 161 and a method using a sensor provided in a conveying path for the recording material S. Other examples thereof include a method based on width information of the recording material S set by a user and a method based on image information for performing image formation on the recording material S.

At S608, energizing control for each heat generating block is performed by using the energizing ratio which is set and fixing processing is performed with a target set temperature of the thermistor TH1 as 200° C.

At S609, whether each of the temperatures of the thermistor TH1 and the thermistor TH2 that are set to the CPU 123 is over or below the predetermined temperature is judged. That is, whether to be over the TH2 abnormal high temperature threshold 1 is judged in the state I, whether to be over the TH2 abnormal high temperature threshold 2 or below the TH2 abnormal low temperature threshold 1 is judged in the state II, and whether to be below the TH2 abnormal low temperature threshold 2 is judged in the state III. When it is detected that each of the temperatures detected with the thermistor signals TH1 and TH2 is over or below the predetermined temperature, the procedure moves to S613. Then, the relay 450 is turned off for emergency stopping (S614), abnormality is reported (S615), and the procedure then ends (S616). When the temperatures of the thermistor TH1 and the thermistor TH2 are in a normal operation range, the procedure moves to S610. When the print job is continued, the procedure returns to S608 and fixing processing is continued. When ending, the relay 450 is turned off at S611, and the control sequence of image formation ends (S612).

Note that, the aforementioned exemplary embodiment indicates a case where there is one thermistor TH2 extending across two heat generating bocks, but it is also allowed to include two or more thermistors. The present exemplary embodiment is able to be applied to a configuration having a larger number of heat generating blocks. Further, the energizing ratio is not limited to the aforementioned ratios.

FIGS. 7A to 7F each illustrates an enlarged portion in which a thermistor TH is arranged so as to extend across two heat generating blocks. A method for arranging the thermistor TH extending across the two heat generating blocks is able to be applied to various patterns of heat generating resistors. One example thereof is illustrated in each of FIGS. 7A to 7F. In either case, a heat generating resistor is divided into a plurality of heat generating blocks which are able to be controlled independently and the thermistor TH is arranged so as to extend across conductive elements or heat generating resistors of the divided two heat generating blocks.

Figure 7A:
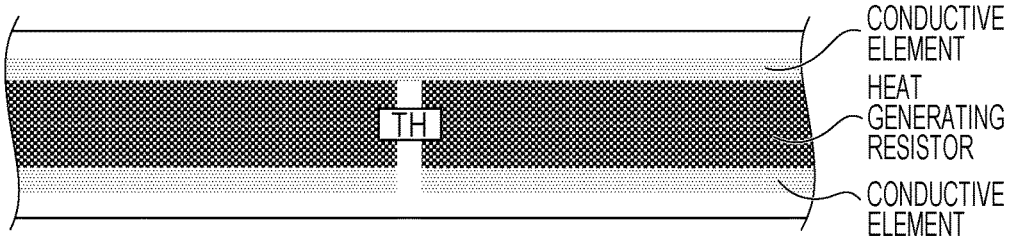
FIGS. 7A to 7F illustrate other configurations of the heater according to the exemplary embodiment 1.

In FIG. 7A, the heat generating resistor is arranged uniformly in an entire heater substrate, a voltage is applied to a portion between conductive elements disposed at each end of the heater substrate in a widthwise direction, and current flows through the heater substrate in the widthwise direction. As illustrated in FIG. 7A, the heat generating resistor is divided into two heat generating blocks at the center and the thermistor TH is arranged to extend across the two right and left heat generating resistors.

Figure 7B:
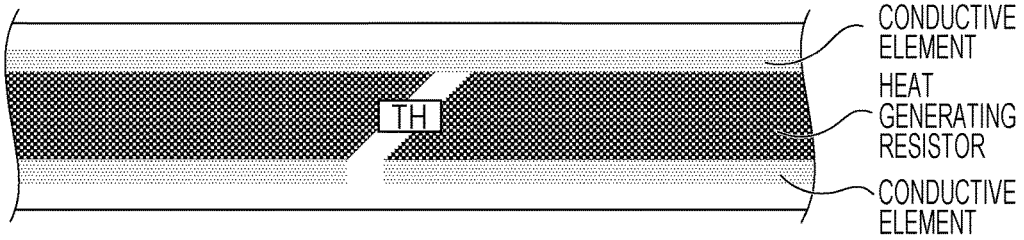

In FIG. 7B, the heat generating resistor is formed uniformly in the entire heater substrate in the same manner as FIG. 7A. A difference lies in that a divided portion of the right and left heat generating blocks has an oblique shape, and when both of the heat generating blocks are heated, the temperature distribution at the divided portion of the heater substrate in the longitudinal direction is attempted to be more uniform than that of FIG. 7A.

Figure 7C:
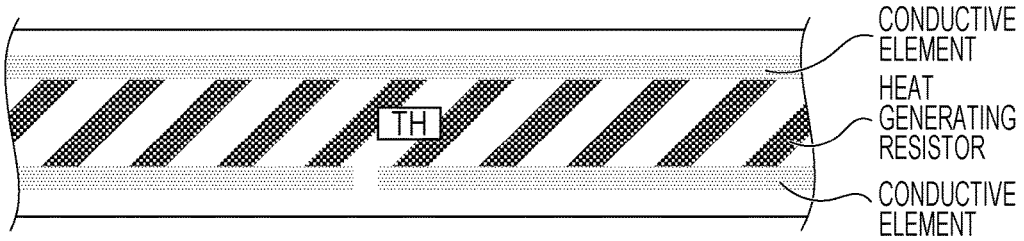

The heat generating resistor of FIG. 7C is obtained by forming the heat generating resistor of FIG. 7B in a lattice pattern, and a plurality of heat generating resistors are arranged evenly in the longitudinal direction of the heater substrate. The current flows obliquely to the longitudinal direction of the heater substrate. In this case, also at the divided portion, the heat generating resistor formed in the lattice pattern is arranged uniformly, that is, arranged uniformly in the longitudinal direction of the heater substrate. When both of the heat generating blocks are heated, the temperature distribution at the divided portion of the heater substrate in the longitudinal direction is able to be formed more uniformly.

Figure 7D:
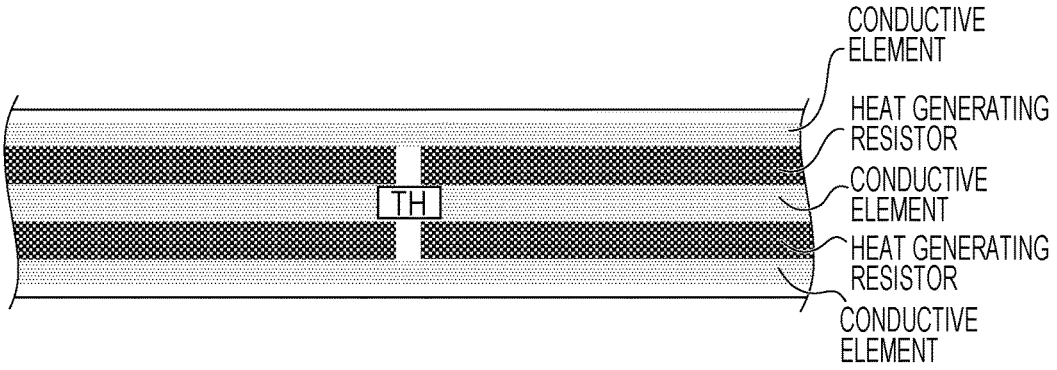

FIG. 7D illustrates the configuration of the present exemplary embodiment described above, in which the heat generating resistor is uniform on the heater substrate and is arranged being divided into an upstream side and a downstream side of the heater substrate in the widthwise direction.

Figure 7E:
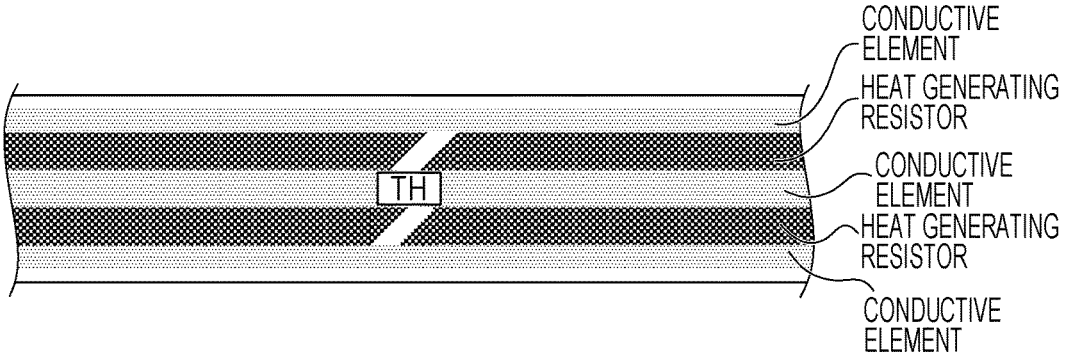

In FIG. 7E, the divided portion between the right and left heat generating blocks is made oblique compared to that of FIG. 7D, and the temperature distribution at the divided portion of the heat generating blocks in the longitudinal direction of the heater substrate is attempted to be uniform.

Figure 7F:
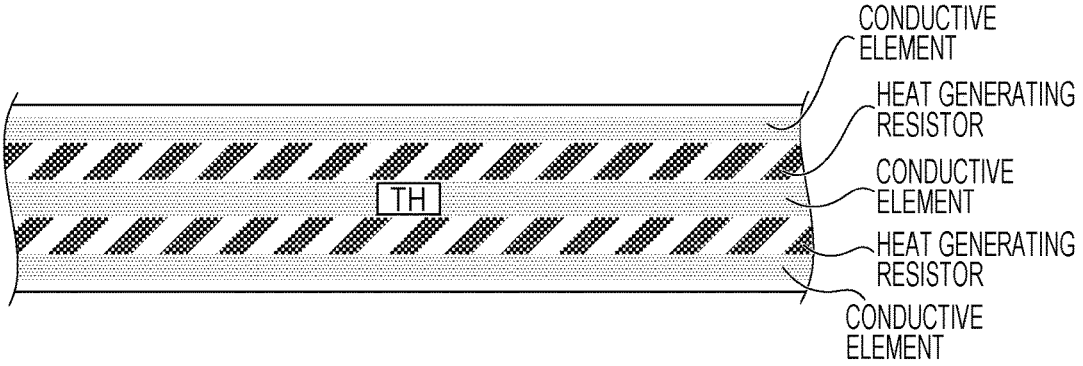

FIG. 7F is obtained by forming the heat generating resistor of FIG. 7E in a lattice pattern and a plurality of heat generating resistors are arranged obliquely. The heat generating resistor is divided into two of an upstream side and a downstream side of the heater substrate in the widthwise direction and the heat distribution of the heater substrate in the widthwise direction and the longitudinal direction is attempted to be uniform.

Note that, each of FIG. 7A to 7E is merely one example, and other applications to any pattern are also allowed.

As described above, according to the present exemplary embodiment, by arranging the thermistor TH2 so as to extend across the heat generating block 302-4 and the heat generating block 302-5, it is possible to reduce the number of thermistors with respect to the number of heat generating blocks and to prevent an increase in a size of the device.

Exemplary Embodiment 2

In an exemplary embodiment 2, a method for individually controlling temperature of each heat generating block will be described. A heater is the same as the heater 102 of the exemplary embodiment 1, but has the different number and positions of thermistors. Note that, the same reference signs will be assigned to similar configurations to those of the exemplary embodiment 1 and description thereof will be omitted.

Figure 8:
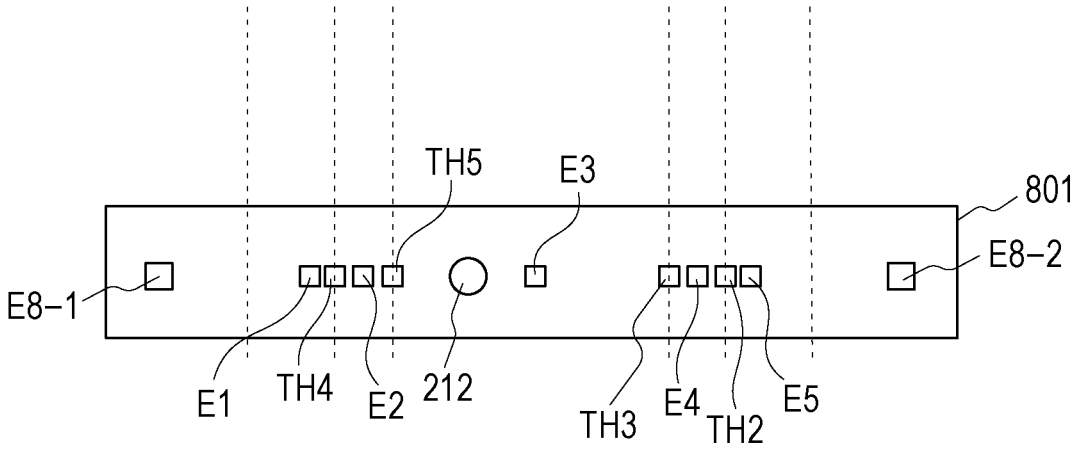
FIG. 8 illustrates a configuration of a heater according to an exemplary embodiment 2.

FIG. 8 is a plan view illustrating a holding member 801 of the heater 102. The heater 102 has a similar configuration to that of FIGS. 3A to 3C. As illustrated in FIG. 8, the holding member 801 of the heater 102 has holes formed for the thermistors TH2 to TH5, the safety element 212, the electrodes E1 to E5, the electrode E8-1, and the electrode E8-2. In the present exemplary embodiment, similarly to the exemplary embodiment 1, the thermistor TH2 is at a position extending across the heat generating block 302-4 and the heat generating block 302-5 and detecting temperatures of both of the heat generating blocks. Similarly, the thermistor TH3 is arranged at a position extending across the heat generating block 302-3 and the heat generating block 302-4. The thermistor TH4 is arranged at a position extending across the heat generating block 302-1 and the heat generating block 302-2. The thermistor TH5 is arranged at a position extending across the heat generating block 302-2 and the heat generating block 302-3. Each electric contact connected to each electrode is connected to a control circuit 900 of the heater 102 described below via a conductive material, such as a cable or a thin metal plate, provided between the stay 204 and the holding member 801.

Figure 9:
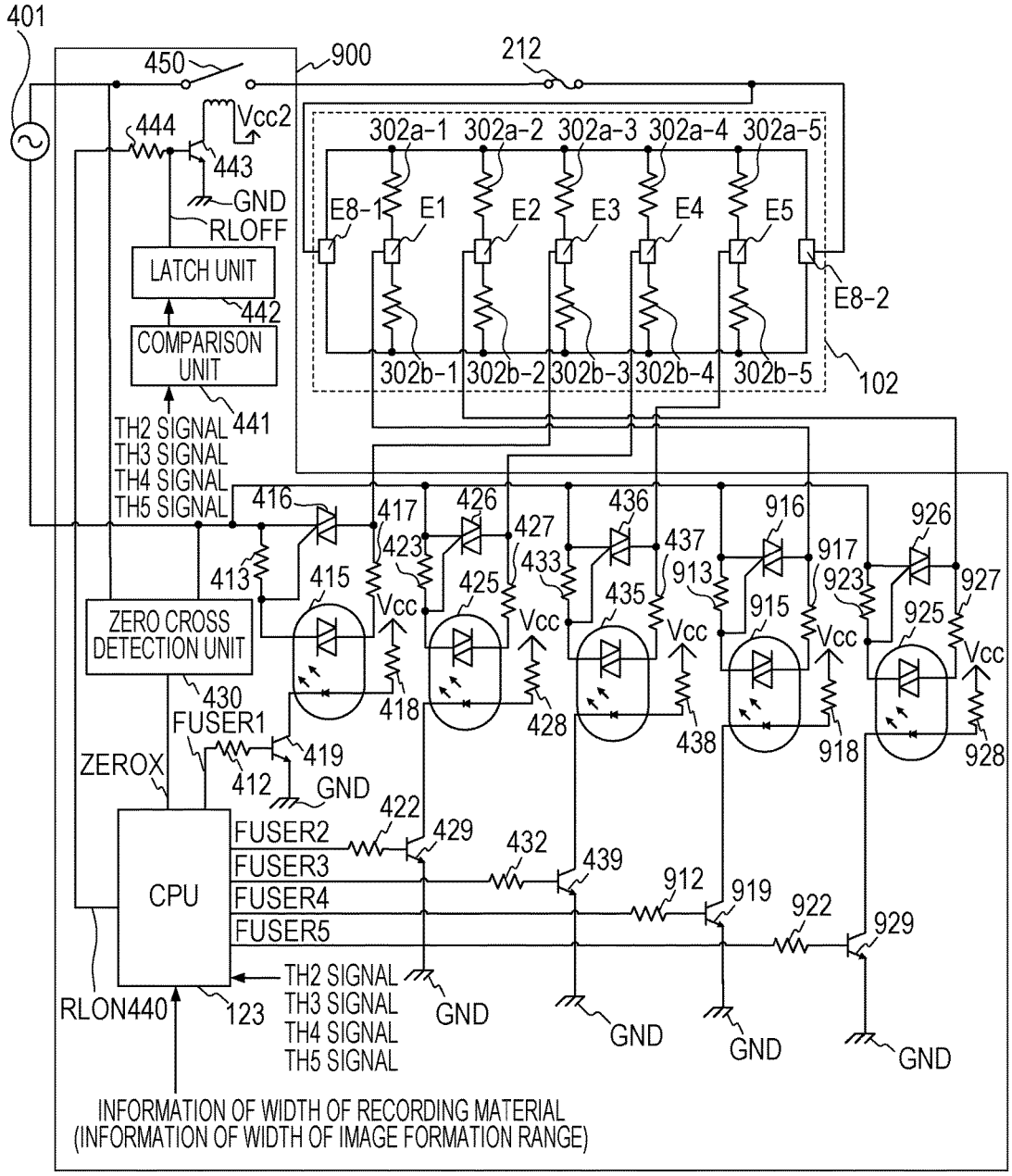
FIG. 9 illustrates a control circuit of the heater according to the exemplary embodiment 2.

FIG. 9 is a circuit diagram of the control circuit 900 for performing power control of the heater 102. The method for controlling power to each of heat generating blocks at symmetrical positions by using three triacs has been described in FIG. 4 of the exemplary embodiment 1. In the present exemplary embodiment, a method for individually controlling power to each of heat generating blocks by using five triacs will be described.

Since circuit operations of a triac 916 and a triac 926 are similar to those of the triac 416 and the like, description thereof will be omitted. The triac 416 operates according to a FUSER1 signal from the CPU 123. When the triac 416 is energized, power is supplied to the heat generating resistor 302*a*-3 and the heat generating resistor 302*b*-3. The triac 426 operates according to a FUSER2 signal from the CPU 123. When the triac 426 is energized, power is supplied to the heat generating resistor 302*a*-4 and the heat generating resistor 302*b*-4. The triac 436 operates according to a FUSER3 signal from the CPU 123. When the triac 436 is energized, power is supplied to the heat generating resistor 302*a*-5 and the heat generating resistor 302*b*-5. The triac 916 operates according to a FUSER4 signal from the CPU 123. When the triac 916 is energized, power is supplied to the heat generating resistor 302*a*-1 and the heat generating resistor 302*b*-1. The triac 926 operates according to a FUSER5 signal from the CPU 123. When the triac 926 is energized, power is supplied to the heat generating resistor 302*a*-2 and the heat generating resistor 302*b*-2.

Figure 11:
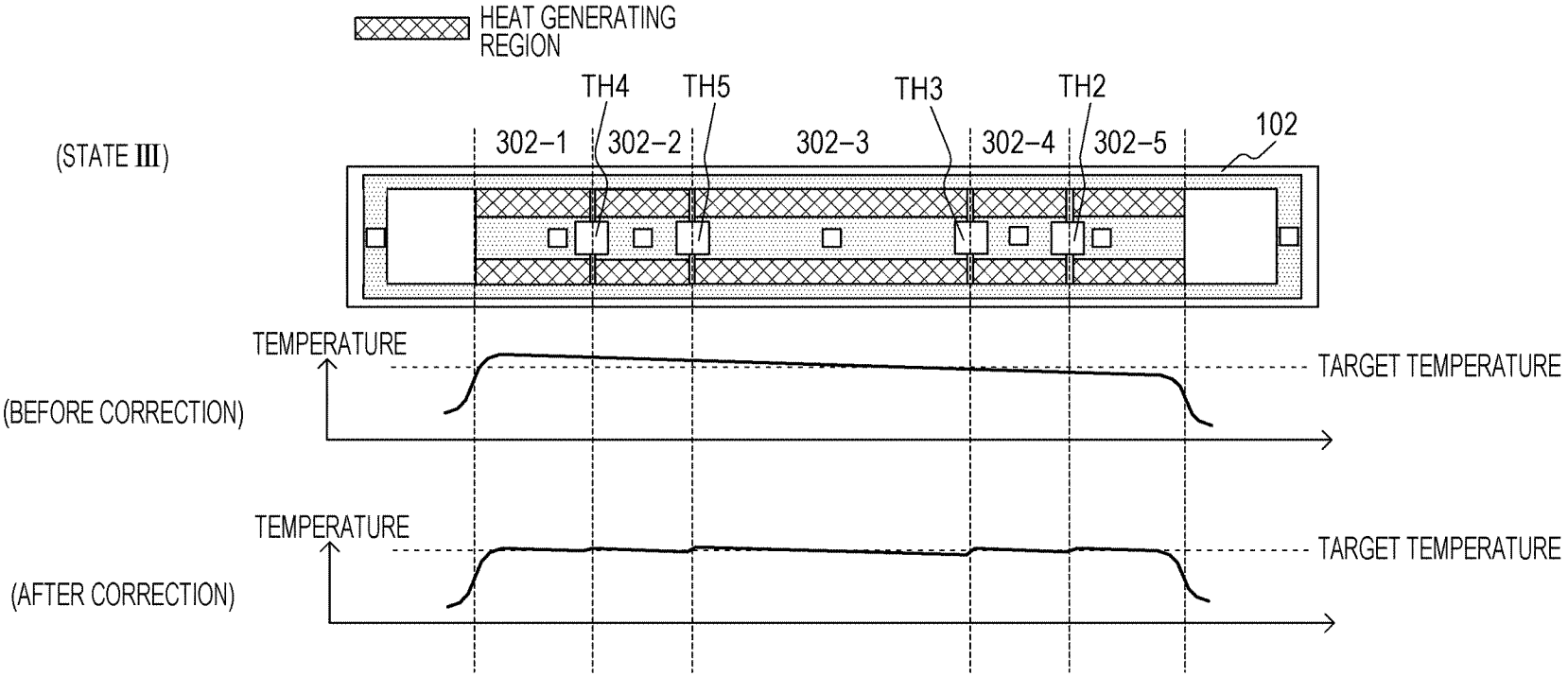
FIG. 11 illustrates temperature distribution of the heater according to the exemplary embodiment 2.

The power control for the heater 102 is performed based on detected temperatures of the thermistor TH3 and the thermistor TH5. Each of the heat generating blocks has a resistance value adjusted so that the heat distribution of the heater 102 in the longitudinal direction is uniform. When each of the heat generating blocks has equal applied voltage and energizing ratio, each of the heat generating blocks has an almost uniform temperature. For example, when the wide recording material S such as Letter paper or Legal paper is passed through, the CPU 123 controls the triacs 416, 426, 436, 916, and 926 based on temperature information from the thermistors TH3 and TH5. Specifically, the CPU 123 controls the energizing ratio to each of the heat generating blocks so that each of the temperatures detected by the thermistors TH3 and TH5 is a desired temperature. However, the temperatures of the heat generating resistors may have variation in the longitudinal direction of the substrate, for example, due to slight non-uniformity of resistance values of each of the heat generating resistors. By detecting the variation in the temperatures with the thermistors TH2 to TH5 and correcting the energizing ratio to each of the heat generating blocks based on the detected temperatures, it is possible to reduce the variation in the temperatures in the longitudinal direction of the substrate. FIG. 11 illustrates an example of the correction. When the temperature control is performed for each of the heat generating blocks of the heater 102 with the same energizing ratio, the temperature on the heat generating block 302-1 side becomes higher and the temperature on the heat generating block 302-5 side becomes lower as indicated in (before correction). Thus, by correcting the energizing ratio to each of the heat generating blocks, the variation in the temperatures is able to be reduced as indicated in (after correction). That is, even though the temperature variation among the heat generating blocks is not able to be corrected, the temperature variation among the heat generating blocks is reduced compared to before correction.

Figure 10:
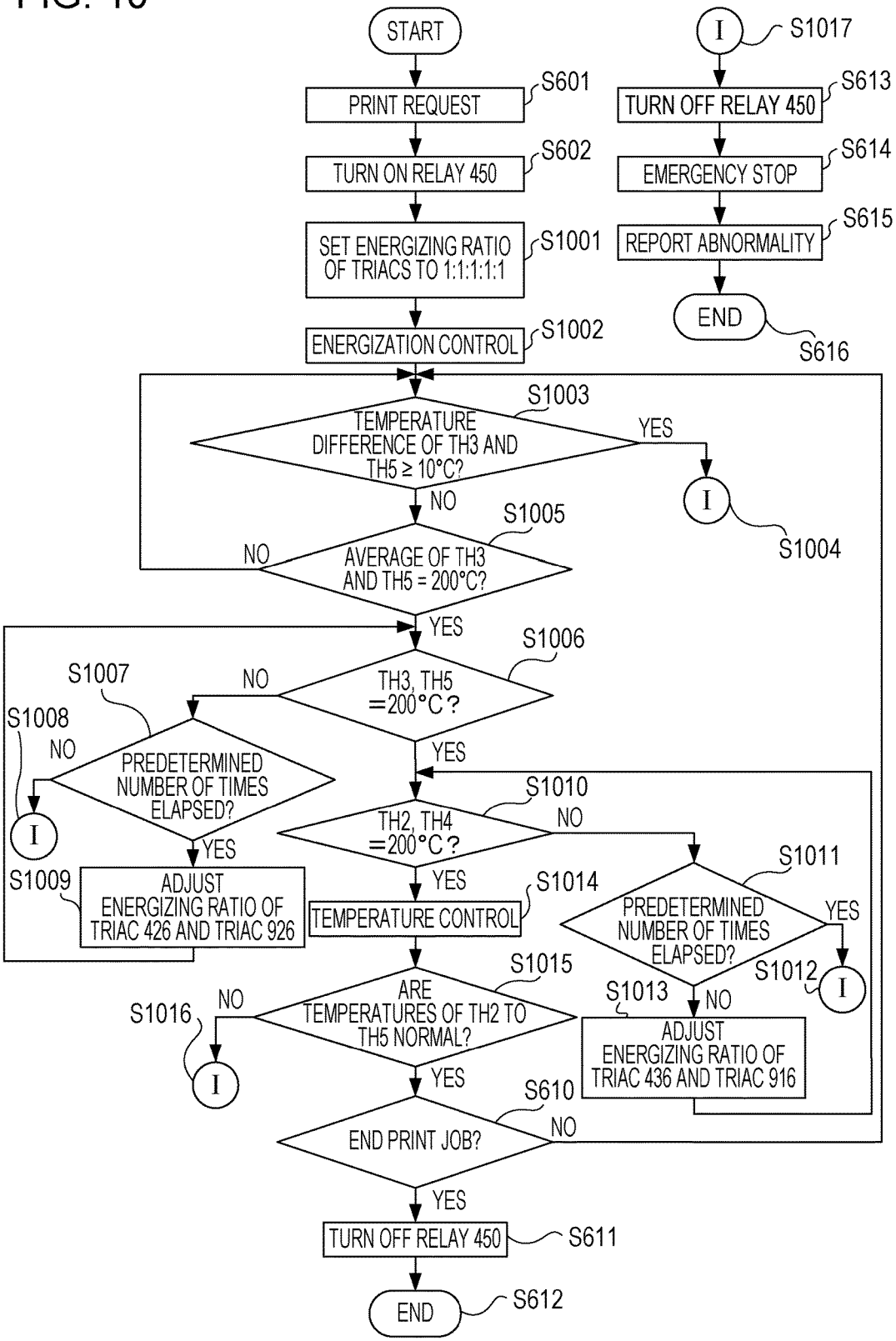
FIG. 10 is a flowchart illustrating control of the heater according to the exemplary embodiment 2.

FIG. 10 is a flowchart for explaining a control sequence of the heat fixing unit 103 by the CPU 123. In this case, a control method when the wide recording material S such as Letter paper or Legal paper is passed through will be described as a representative.

The CPU 123 receives a print request (S601), and turns on the relay 450 (S602). Then, for starting energization to each of the heat generating blocks of the heat generating blocks 302-1 to 302-5, the CPU 123 sets the energizing ratio of the triacs 416, 426, 436, 916, and 926 to be all the same at 1:1:1:1:1 (S1001) and starts control (S1002). At this time, the CPU 123 obtains an average of the temperatures of the thermistors TH3 and TH5 and performs the control so that this average temperature serves as a target temperature (S1005). At the same time, the CPU 123 detects a temperature difference between the thermistors TH3 and TH5 (S1003), and when the temperature difference is 10° C. or more, judges to be abnormal (S1003) and turns off the relay 450 (S1004 to S1017 to S613). Then, the CPU 123 performs emergency stop (S614) and reports abnormality (S615), then ends the procedure (S616).

When the average temperature between the thermistor TH3 and the thermistor TH5 reaches the target temperature, the CPU 123 firstly compares the temperature of the thermistor TH3 to the target temperature and the temperature of the thermistor TH5 to the target temperature (S1006). When the temperature of the thermistor TH3 is higher than the target temperature, the energizing ratio of the triac 426 is reduced to reduce the temperature of the heat generating block 302-4. To the contrary, when the temperature of the thermistor TH3 is lower than the target temperature, the energizing ratio of the triac 426 is increased to increase the temperature of the heat generating block 302-4 (S1009). Similarly, the CPU 123 compares the temperature of the thermistor TH5 to the target temperature, and adjusts the energizing ratio of the triac 926 to adjust the temperature of the heat generating block 302-2 (S1009). At this time, the CPU 123 detects the number of times of repetition of a routine of S1006 to S1009 (S1007). In a case where the temperatures of the thermistors TH3 and TH5 do not reach the target temperature even after the predetermined number of repetition (which may be a case where a temperature difference from the target temperature is not a predetermined value or less), the CPU 123 judges to be abnormal (S1008) and performs a deactivation process (S1017 to S613 to S616).

Next, at S1010, the CPU 123 compares the temperature of the thermistor TH2 to the target temperature, and the temperature of the thermistor TH4 to the target temperature (S1010). When the temperature of the thermistor TH2 is higher than the target temperature, the energizing ratio of the triac 436 is reduced to reduce the temperature of the heat generating block 302-5. To the contrary, when the temperature of the thermistor TH2 is lower than the target temperature, the energizing ratio of the triac 436 is increased to increase the temperature of the heat generating block 302-5 (S1013). Similarly, the CPU 123 compares the temperature of the thermistor TH4 to the target temperature, and adjusts the energizing ratio of the triac 916 to adjust the temperature of the heat generating block 302-1 (S1013). At this time, the CPU 123 detects the number of times of repetition of a routine of S1010 to S1013 (S1011). In a case where the temperatures of the thermistors TH2 and TH4 do not reach the target temperature even after the predetermined number of repetition (which may be a case where a temperature difference from the target temperature does not become a predetermined value or less), the CPU 123 judges to be abnormal (S1012) and performs a deactivation process (S1017 to S613 to S616).

When the temperatures of the thermistor TH2 and the thermistor TH4 reach the target temperature, the CPU 123 continues the temperature control for the heater 102 while maintaining the adjusted energizing ratio of each triac (S1014). Then, the CPU 123 judges whether the thermistors TH2 to TH5 are within a normal temperature range at S1015 (S1015) and judges whether to continue the print job (S610), and when continuing, returns to S1003.

The aforementioned method for correcting the temperature variation among the heat generating blocks 302-1 to 302-5 is one example, and other methods are also allowed for correcting the variation based on the detected temperatures of the thermistors TH2 to TH5.

Figure 12:
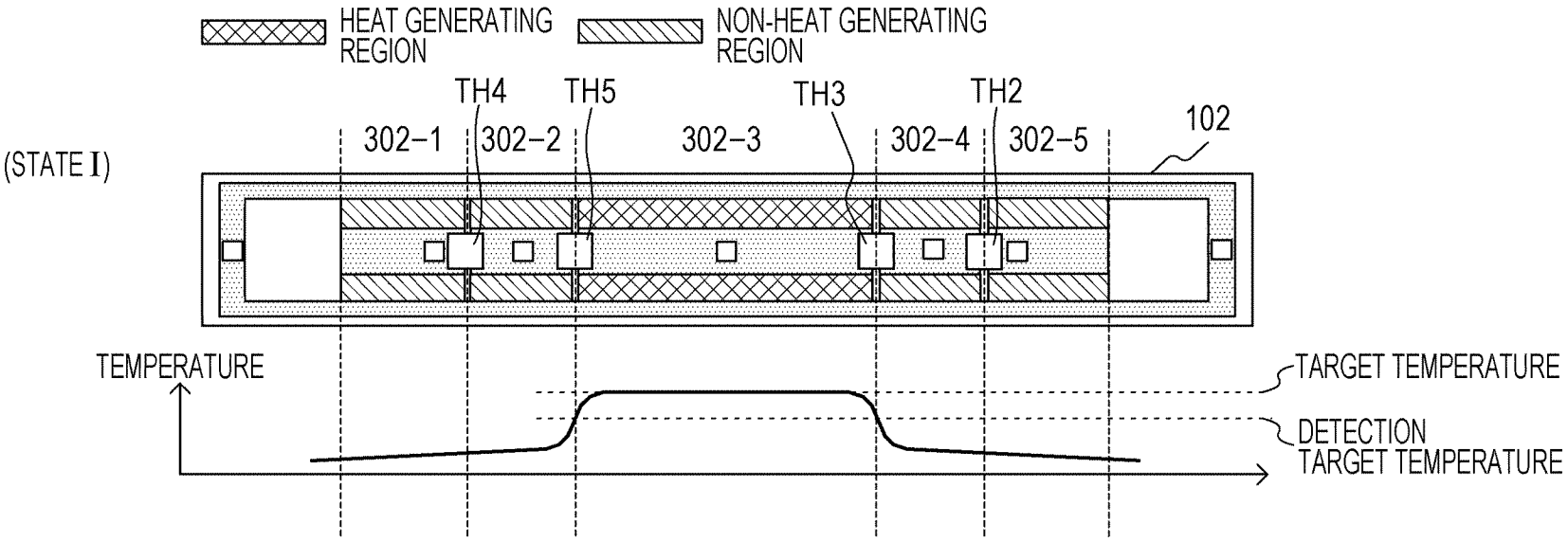
FIG. 12 illustrates temperature distribution of the heater according to the exemplary embodiment 2.

The control method when the wide recording material S, such as Letter paper or Legal paper, having the maximum size is passed through has been described above. In a case of small-sized paper, such as A5 paper, having a width up to 157 mm, the temperature of each of the heat generating blocks to be energized is able to be controlled uniformly by performing a basic control method similarly to the aforementioned method. In the case of the recording material S having the smallest width, that is, small-sized paper having a width up to 115 mm, only the heat generating block 302-3 is controlled and the heat generating blocks 302-1 to 302-2 and the heat generating blocks 302-4 to 302-5 are not energized. Thus, the temperatures detected by the thermistors TH3 and TH5 are temperatures lower than the target temperature (FIG. 12). The CPU 123 stores in advance the detected temperatures of the thermistors TH3 and TH5 and a temperature transition thereof when only the heat generating block 302-3 is controlled with a set temperature. The CPU 123 monitors the detected temperatures of the thermistors TH3 and TH5 so that the heat generating block 302-3 is controlled at the target temperature and performs control to achieve the target temperature of FIG. 12.

In the examples above, though uniformity of temperatures of the heat generating blocks is corrected by providing the thermistors TH2 to TH5, the number of thermistors may be of course increased. When the number of thermistors is increased, each of the thermistors may be arranged near the center of the respective heat generating blocks. Further, as a control method, temperatures detected by the thermistors TH2 to TH5 and corrected power supply ratio of heat generating blocks are measured and stored in a memory or the like in advance at a factory or the like. Then, by using information of the memory in actual control, the power supply ratio for each of the heat generating blocks may be corrected.

As described above, according to the present exemplary embodiment, by arranging the thermistors TH2 to TH5 so as to extend across each two heat generating blocks of the heat generating blocks 302-1 to 302-5, it is possible to reduce the number of thermistors with respect to the number of heat generating blocks and simplify a configuration of a heat fixing unit.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-179570, filed on Sep. 11, 2015, which is hereby incorporated by reference herein in its entirety.

What is claimed is:

1. An image heating device, comprising:

a heater having a substrate, a first heat generating block which is formed on the substrate and generates heat by supplied power, and a second heat generating block which is formed on the substrate and generates heat by supplied power and which is arranged at a position different from a position at which the first heat generating block is arranged in a longitudinal direction of the substrate;

a temperature detecting element; and a controller to which a signal from the temperature detecting element is input, wherein the controller controls a ratio of power supplied to the first heat generating block to power supplied to the second heat generating block to thereby switch heat generation distribution of the heater, wherein the temperature detecting element is arranged so as to extend across both of the first heat generating block and the second heat generating block, and wherein the controller judges that an abnormality has occurred when a detected temperature of the temperature detecting element reaches a threshold which is set according to the ratio.

2. The image heating device according to claim 1, wherein the ratio is set according to a size of a recording material.

3. The image heating device according to claim 1, wherein the controller controls power supplied to the first heat generating block and the second heat generating block based on a detected temperature of the temperature detecting element.

4. The image heating device according to claim 1, wherein each of the first and second heat generating blocks is constituted so that current flows through a heat generating resistor in each of the first and second heat generating blocks in a widthwise direction of the substrate.

5. The image heating device according to claim 1, further comprising a cylindrical film which rotates with an inner surface thereof in contact with the heater.

6. An image forming apparatus, comprising:

an image forming unit which forms an image on a recording material;

a fixing unit which fixes the image onto the recording material, the fixing unit comprising a heater having a substrate, a first heat generating block which is formed on the substrate and generates heat by supplied power, and a second heat generating block which is formed on the substrate and generates heat by supplied power and which is arranged at a position different from a position at which the first heat generating block is arranged in a longitudinal direction of the substrate, and a temperature detecting element; and a controller to which a signal from the temperature detecting element is input, wherein the controller controls a ratio of power supplied to the first heat generating block to power supplied to the second heat generating block to thereby switch heat generation distribution of the heater, wherein the temperature detecting element is arranged so as to extend across both of the first heat generating block and the second heat generating block, and wherein the controller judges that an abnormality has occurred when a detected temperature of the temperature detecting element reaches a threshold which is set according to the ratio.

7. The image forming apparatus according to claim 6, wherein the ratio is set according to a size of the recording material.

8. The image forming apparatus according to claim 6, wherein the controller controls power supplied to the first heat generating block and the second heat generating block based on a detected temperature of the temperature detecting element.

9. The image forming apparatus according to claim 6, wherein each of the first and second heat generating blocks is constituted so that current flows through a heat generating resistor in each of the first and second heat generating blocks in a widthwise direction of the substrate.

10. The image forming apparatus according to claim 6, wherein the fixing unit further comprises a cylindrical film which rotates with an inner surface thereof in contact with the heater.

* * * * *